US008661725B1

(12) United States Patent
Ganther et al.

(10) Patent No.: US 8,661,725 B1
(45) Date of Patent: Mar. 4, 2014

(54) REMOVABLY COUPLED BORESIGHT CAMERA ASSEMBLY FOR ALIGNING WEAPONS

(71) Applicant: Graflex, Inc., Jupiter, FL (US)

(72) Inventors: Christopher Paul Ganther, Stuart, FL (US); Stephen Raymond Teklinski, Loxahatchee, FL (US); Earle Norman Phillips, Palm Beach Gardens, FL (US)

(73) Assignee: Graflex, Inc., Jupiter, FL (US)

( * ) Notice: Subject to any disclaimer, the term of this patent is extended or adjusted under 35 U.S.C. 154(b) by 0 days.

(21) Appl. No.: 13/715,542

(22) Filed: Dec. 14, 2012

Related U.S. Application Data

(60) Provisional application No. 61/708,217, filed on Oct. 1, 2012.

(51) Int. Cl.
*F41G 1/38* (2006.01)

(52) U.S. Cl.
USPC ..... 42/121; 42/119

(58) Field of Classification Search
USPC ..... 42/111–116, 119, 120, 121, 124, 134
See application file for complete search history.

(56) References Cited

U.S. PATENT DOCUMENTS

| | | | | | |
|---|---|---|---|---|---|
| 2,696,052 | A * | 12/1954 | Czarnikow | 359/427 |
| 3,545,356 | A * | 12/1970 | Nielsen | 396/426 |
| 3,709,124 | A * | 1/1973 | Hunt | 396/426 |
| 3,911,451 | A | 10/1975 | Vockenhuber | |
| 4,534,116 | A * | 8/1985 | Davis | 42/121 |
| 4,733,490 | A * | 3/1988 | Mulawski | 42/134 |
| 4,750,269 | A * | 6/1988 | Townsend et al. | 42/121 |
| 4,825,258 | A * | 4/1989 | Whitson | 356/153 |
| 5,020,262 | A | 6/1991 | Pena | |
| 5,396,708 | A * | 3/1995 | Whitley | 42/121 |
| 5,454,168 | A * | 10/1995 | Langner | 42/116 |
| 5,486,913 | A * | 1/1996 | Aharon | 356/153 |
| 5,694,202 | A * | 12/1997 | Mladjan et al. | 356/4.01 |
| 6,295,753 | B1 * | 10/2001 | Thummel | 42/116 |
| 6,397,509 | B1 * | 6/2002 | Langner | 42/116 |
| 6,421,947 | B1 * | 7/2002 | Fuller | 42/116 |
| 6,729,223 | B2 * | 5/2004 | De Lapasse | 89/41.17 |
| 6,810,615 | B2 * | 11/2004 | Hermanson et al. | 42/76.1 |
| 7,265,944 | B1 * | 9/2007 | Coon et al. | 360/244.8 |
| 7,832,137 | B2 * | 11/2010 | Sammut et al. | 42/111 |
| 7,900,391 | B1 * | 3/2011 | Mihelish | 42/116 |
| 8,104,216 | B2 * | 1/2012 | Uhm | 42/111 |
| 2007/0009860 | A1 * | 1/2007 | Young | 434/21 |
| 2007/0144051 | A1 * | 6/2007 | Moore et al. | 42/116 |
| 2007/0169392 | A1 * | 7/2007 | Davis | 42/116 |

(Continued)

*Primary Examiner* — Bret Hayes
*Assistant Examiner* — Joshua Freeman
(74) *Attorney, Agent, or Firm* — Jetter & Associates, P.A.

(57) ABSTRACT

A method of boresighting includes providing a weapon including a bore having a centerline axis and a boresight telescope coupled into the bore. The boresight telescope has a beam splitter therein which directs image information received from an aiming reference to an eyepiece of the boresight telescope which is off-axis relative to the centerline axis. A boresight camera accessory (BCA) is removably coupled to the eyepiece. The BCA includes an objective and a photodetector array, wherein the objective focuses the image information from the eyepiece to the photodetector array which generates sensing signals. The sensing signals are automatically transmitted to at least one remote viewer, and a viewable image of the aiming reference is displayed from the sensing signals. The remote viewer individually boresights the weapon using the viewable image and a view of the aiming reference through the bore.

16 Claims, 4 Drawing Sheets

(56) References Cited

U.S. PATENT DOCUMENTS

2009/0021723 A1* 1/2009 De Lega ..... 356/73
2009/0133572 A1* 5/2009 Izraeli ..... 89/41.05
2009/0260270 A1* 10/2009 Wu ..... 42/133
2010/0142036 A1* 6/2010 Sterns et al. ..... 359/363
2011/0288804 A1* 11/2011 Lee et al. ..... 702/87
2012/0106170 A1* 5/2012 Matthews et al. ..... 362/311.06
2012/0167440 A1* 7/2012 StPhillips et al. ..... 42/116

* cited by examiner

REMOVABLY COUPLED BORESIGHT CAMERA ASSEMBLY FOR ALIGNING WEAPONS

CROSS REFERENCE TO RELATED APPLICATIONS

This application claims the benefit of Provisional Application Ser. No. 61/708,217 entitled "REMOVABLY COUPLED BORESIGHT CAMERA ASSEMBLY FOR ALIGNING WEAPONS", filed Oct. 1, 2012, which is herein incorporated by reference in its entirety.

FIELD

Disclosed embodiments related to boresight telescopes for zeroing direct fire weapons.

BACKGROUND

Boresighting is an alignment process by which the weapon tube centerline (centerline axis) and gunner's optical sighting system are referred to the same aiming point. This operation typically requires two people, a fire control system operator (or gunner) inside the vehicle and an assistant looking through the optical boresight telescope attached to an adapter/mandrel which is inserted into the bore of the weapon's barrel.

FIG. 1 depicts a tank 100 having a boresight telescope 160 including an eyepiece 161, an objective assembly 163, and a shank 164, mounted via an adapter (or mandrel) 150 which is inserted into the bore 18*a* of the gun barrel 18 for boresighting (or zeroing). On an armored vehicle such as the tank 100, the gun turret 20 is operated in azimuth and elevation to accomplish the boresight, and the gunner within the vehicle cannot see where the boresight telescope 160 is pointed. As a result, an individual looking through the eyepiece 161 of the boresight telescope 160 in front of the gun barrel 18 can be injured by unexpected movements of the gun barrel 18.

Some have disclosed direct view boresight cameras, but have generally been unable to demonstrate the accuracy claimed on their data sheets, with an actual tuning accuracy limited to no better than about +/−0.1 angular mils. These known boresight cameras are direct view, meaning the images obtained are parallel to the centerline axis of the bore of the weapon.

SUMMARY

This Summary is provided to introduce a brief selection of disclosed concepts in a simplified form that are further described below in the Detailed Description including the drawings provided. This Summary is not intended to limit the claimed subject matter's scope.

Disclosed embodiment recognize with appropriate mounting structures a boresight camera assembly (BCA) can be removably mounted onto an optical boresight telescope while providing high positional (angle and distance) accuracy and precision between successive placements of the BCA relative to the optics of the boresight telescope. The image quality provided by disclosed embodiments including BCA placement-to-placement has been found to approach the image quality obtainable directly from the boresight telescope, so that there is essentially no degradation of image quality in images obtained when using disclosed BCAs.

Being removably mounted allows the BCA to be used as an accessory to capture the image provided by the boresight telescope's eyepiece. In disclosed embodiments the BCA is only used during the boresight operation, when the boresight telescope is mounted into the bore of the weapon, and is not used when the weapon is being fired or is otherwise able to be fired.

The image from the BCA can be relayed and displayed to a remote viewer, such as a gunner using a dedicated video display (e.g., Liquid Crystal Display (LCD)) inside a military vehicle (e.g., an armored vehicle, such as a tank) or the gunner's LCD where a fire control system is located, so that the remote viewer (e.g., gunner) can by himself or herself perform boresighting. If the BCA should fail to operate, the BCA can be removed and the user can still accomplish all boresight tasks using the boresight telescope. Moreover, disclosed embodiments provide an improvement in safety by eliminating the possibility of injury due to unexpected movements of the gun barrel while two individuals perform boresighting of a remote fire control system.

Disclosed embodiments include a method of boresighting comprising providing a weapon including a bore having a centerline axis and a boresight telescope coupled into the bore. The boresight telescope has a beam splitter therein which directs image information received from an aiming reference to an eyepiece of the boresight telescope which is off-axis relative to the centerline axis. A BCA is removably coupled to the eyepiece. The BCA includes an objective and a photodetector array, wherein the objective focuses the image information from the eyepiece to the photodetector array which generates sensing signals. The sensing signals are automatically transmitted to at least one remote viewer, and a viewable image of the aiming reference is displayed from the sensing signals. The remote viewer individually boresights the weapon using the viewable image and a view of the aiming reference through the bore.

DETAILED DESCRIPTION

Figure 1:
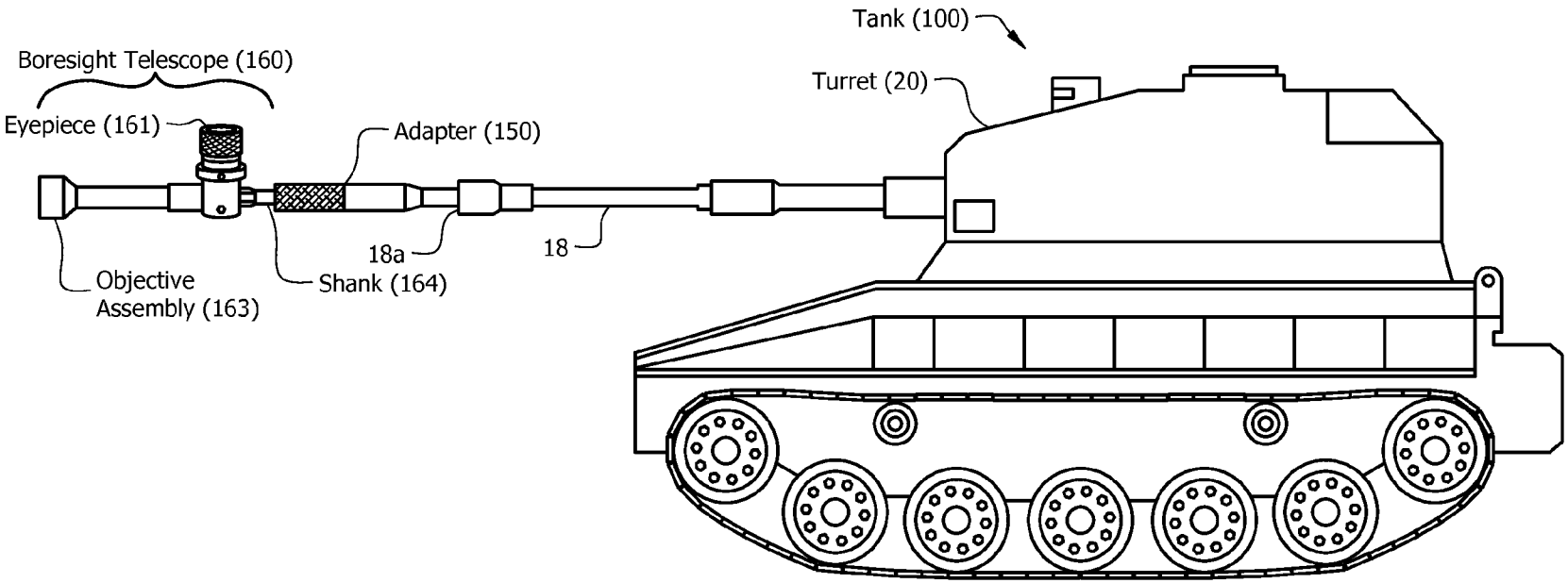
FIG. 1 (Prior Art)
FIG. 1 depicts a tank having a boresight telescope including an eyepiece mounted via an adapter into the bore of the gun barrel for boresighting.

Disclosed embodiments in this Disclosure are described with reference to the attached figures, wherein like reference numerals are used throughout the figures to designate similar or equivalent elements. The figures are not drawn to scale and they are provided merely to illustrate the disclosed embodiments. Several aspects are described below with reference to example applications for illustration. It should be understood that numerous specific details, relationships, and methods are set forth to provide a full understanding of the disclosed embodiments. One having ordinary skill in the relevant art, however, will readily recognize that the subject matter disclosed herein can be practiced without one or more of the specific details or with other methods. In other instances, well-known structures or operations are not shown in detail to avoid obscuring structures or operations that are not well-known. This Disclosure is not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Figure 2:
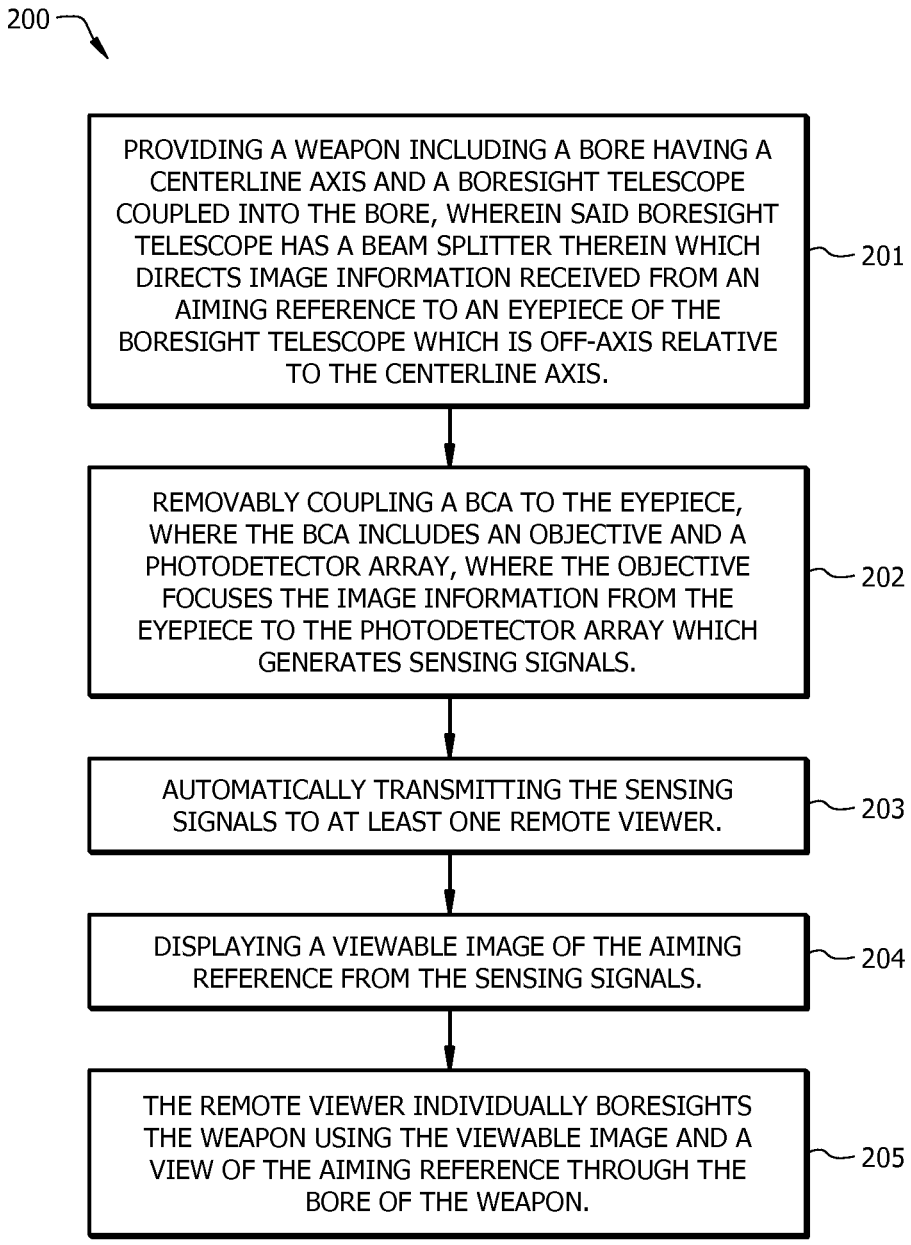
FIG. 2 is a flow chart that shows steps in an example method of boresighting, according to an example embodiment.

FIG. 2 is a flow chart that shows steps in an example method 200 of remotely viewing a firing target, according to an example embodiment. Step 201 comprises providing a weapon including a bore having a centerline axis and a boresight telescope coupled into the bore, wherein the boresight telescope has a beam splitter therein which directs image information received from an aiming reference to an eyepiece of the boresight telescope which is off-axis relative to the centerline axis. The weapon can comprise a tank, Gatling gun or a machine gun. An adapter (or mandrel) can be used to couple the boresight telescope into the bore. The aiming reference can be a distant corner of a building, or a telephone pole, for example.

Step 202 comprises removably coupling a BCA to the eyepiece, where the BCA includes an objective and a photodetector array. An appropriate mounting structure is provided so that the BCA can be removably mounted onto the boresight telescope while providing high positional (angle and distance) accuracy and precision between successive placements of the BCA relative to the optics of the boresight telescope. The objective focuses the image information from the eyepiece to the photodetector array which generates electrical sensing signals.

Step 203 comprises automatically transmitting the sensing signals to at least one remote viewer. Step 204 comprises displaying a viewable image of the aiming reference from the sensing signals. Step 205 comprises the remote viewer individually boresighting the weapon using the viewable image and a view of the aiming reference through the bore of the weapon. Since one person can accomplish all boresighting tasks, there is no chance of miscommunication with respect to the exact point used for the aiming reference. In disclosed embodiments, the BCA is only used during the boresight operation, and the BCA and boresight telescope is removed to enable the weapon to be fired or otherwise able to be fired.

Figure 3A:
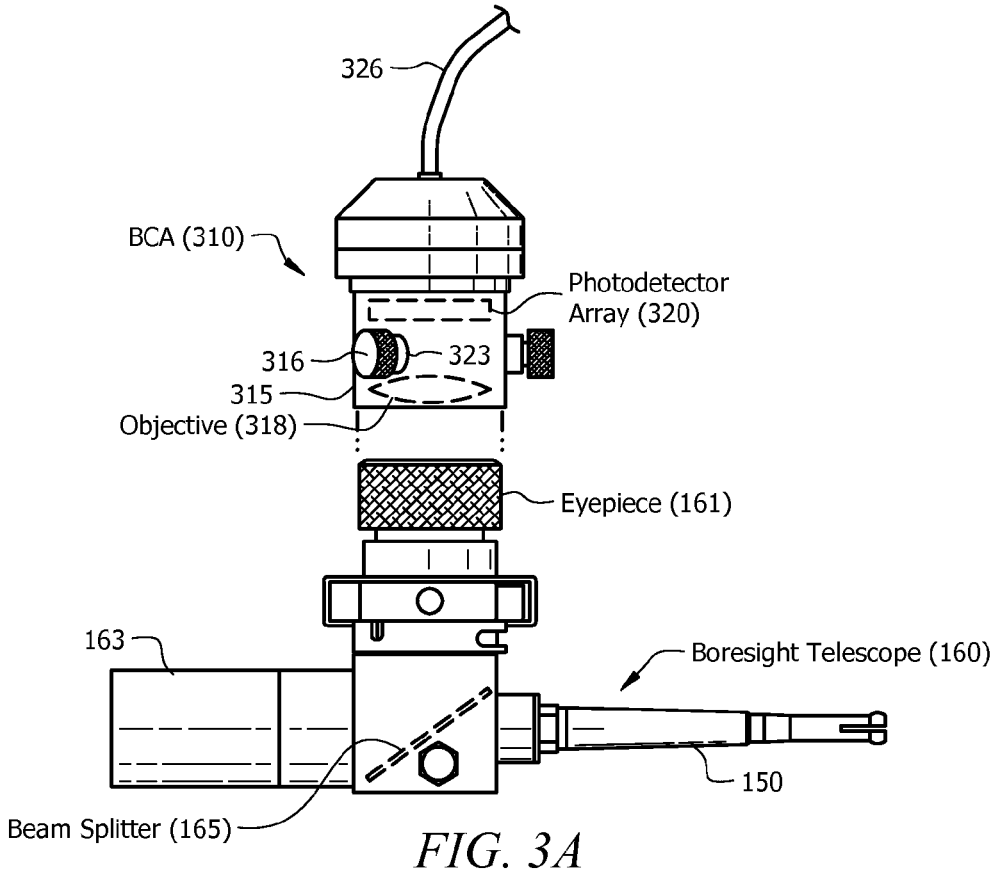
FIG. 3A is a side view of an example BCA positioned above a boresight telescope, according to an example embodiment.

FIG. 3A is a side view of an example BCA 310 positioned above a boresight telescope 160. BCA 310 includes an outer housing 315, an objective 318 and a photodetector array 320. The BCA 310 may be powered directly from a battery, such as a 12 Vdc, or 24 Vdc battery, vehicle power, or by a rechargeable battery system with capacity for use over several days before recharging is required.

Boresight telescope 160 is shown including a beam splitter 165 for splitting a beam of light into a transmitted and a reflected light beam. As known in optics, beam splitter 165 can comprise a cube made from two triangular prisms which are secured (e.g., glued) together at their base, a half-silvered minor, or a dichroic mirrored prism assembly which uses dichroic optical coatings.

Housing 315 is a sealed housing to avoid the entrance of contaminants therein. The sealing mechanism utilized can be selected from a variety of known sealing structures (e.g., gaskets such as o-rings), and the housing 315 can be formed from materials which are resistant to deformation (e.g., anodized aluminum). The objective 318 focuses the image information of the aiming reference from the eyepiece 161 (received via the reflected beam from beam splitter 165) to the photodetector array 320 which generates sensing signals.

Disclosed embodiments recognize the BCA 310 can be removably coupled to the eyepiece 161 of the boresight telescope 160 in certain ways which provide high positional (angle and distance) accuracy and precision between successive placements of the BCA 310 relative to the optics of the eyepiece 161 of the boresight telescope 160. Positional accuracy upon each placement of the BCA 310 is needed to avoid image distortion due to changes in angle or position between the eyepiece 161 and the optical components of the BCA 310.

Figure 3B:
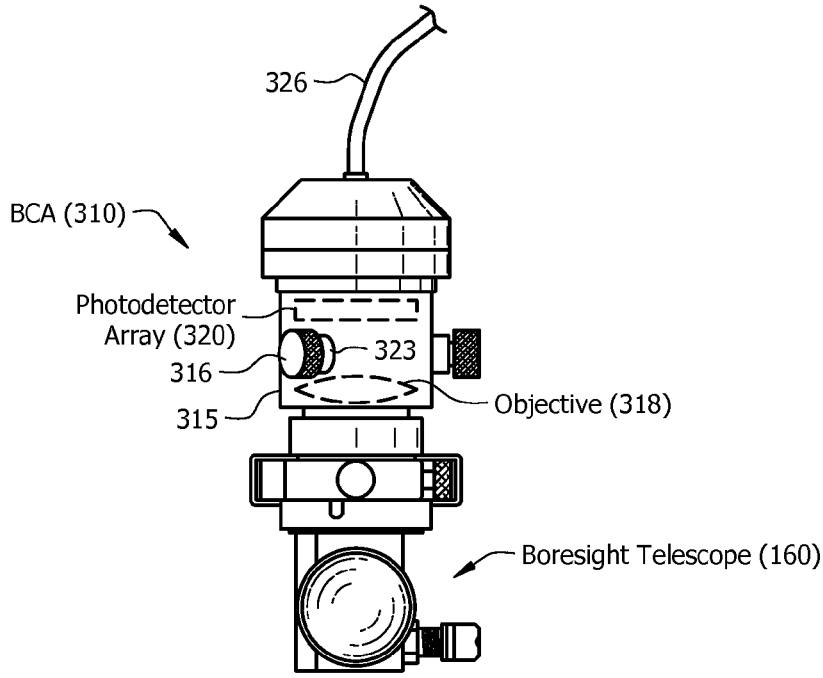
FIG. 3B is a front view of an example BCA mounted onto a boresight telescope according to an example embodiment.

FIG. 3A shows one such example, being a grommet 323 inserted into first and second through-holes in the housing 315 configured for receiving a fastener (e.g., screw) 316 that is movable within the hole and extendable into the housing 315 for accurately and precisely securing the BCA 310 to an inner structural member described herein as the eyepiece 161 in FIGS. 3A and 3B. The through-holes can be threaded for receiving the fastener 316.

The positions of the holes in the housing 315 are carefully formed to ensure they are at essentially the same axial height so that the BCA 310 when placed will not be tilted relative to the horizontal plane. Fastener 316 is also retractable out of the housing. Grommets 323 are generally flared or collared on each side to keep them in place, and can be made from metal, plastic, or rubber. Grommets 323 help prevent tearing or abrasion of the pierced material of the housing 315 that might otherwise lead to movement of the BCA 310 relative to the eyepiece 161 of the boresight telescope 160. Other removable coupling arrangements that provide high positional accuracy and precision between placements can include certain threading or certain magnetic coupling arrangements.

A cable 326 is shown for automatically transmitting sensing signals (image data) from the photodetector array 320 to a fire control system operator, or gunner. In some embodiments, the fire control operator is inside a vehicle, such as a tank. Alternatively, the sensing signals may be transmitted by wireless (e.g., RF) or optical (e.g., laser) transmission. The sensing signals upon receipt can then be displayed on an existing video display (e.g., gunner's LCD), or another (e.g., dedicated LCD) display.

The BCA 310 can in one embodiment comprise a commercial off-the-shelf (COTS) charge-coupled device (CCD) camera. The objective 318 can be a lens or combination of lenses with an effective focal length calculated to fill the area of the photodetector array 320 without excessive vignetting. Vignetting is seen as an effect where the corners are darkened in a rectangular display, resulting in a rounded image.

The BCA 310 can include a structure for providing near parallax-free operation. Parallax is a condition that occurs when the image of the aiming reference (or target) is not focused precisely on the reticle plane, where the "primary image" of the aiming reference (or target) is formed either in front of, or behind the reticle. For example, near parallax-free operation can be provided up to about 200 meters by including a black aperture stop lens cap, such as a cap placed on the objective using an approximately ¼ inch hole.

FIG. 3B is a front view of the example BCA 310 in FIG. 3A mounted onto the boresight telescope 160. The fasteners 316 secure the BCA 310 to the outer surface of the eyepiece 161 of the boresight telescope 160.

Figure 4:
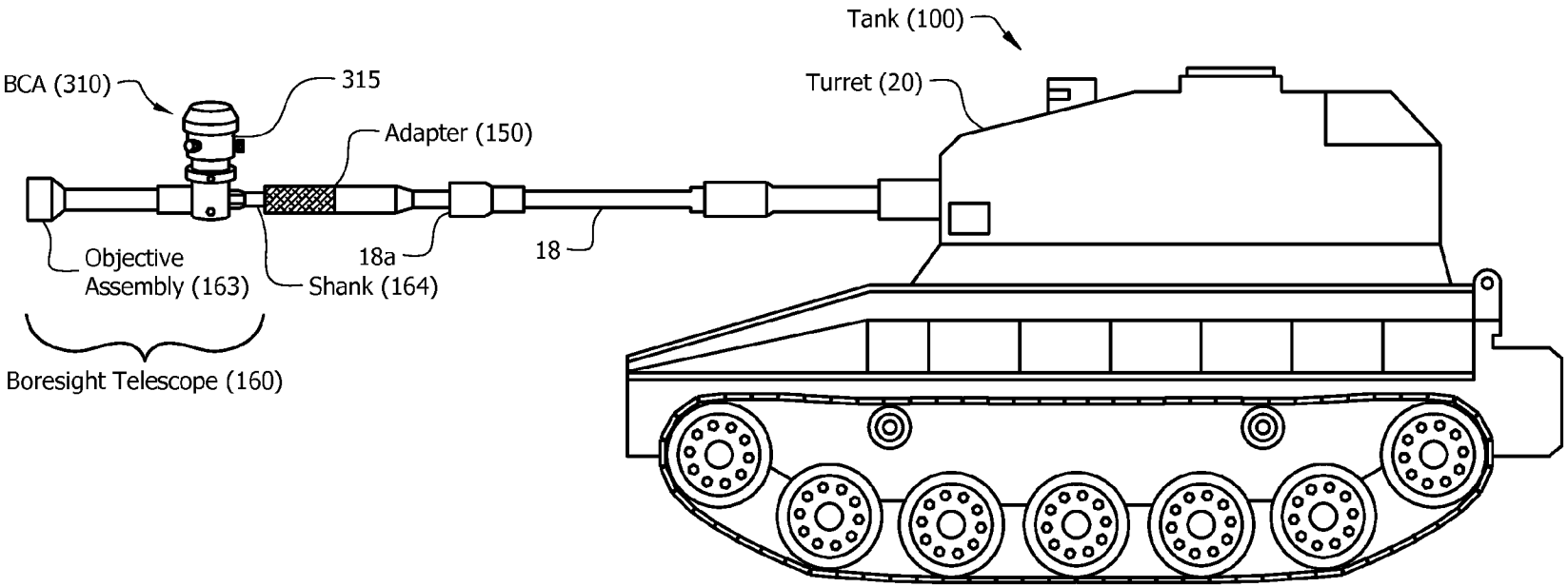
FIG. 4 depicts a tank having a boresight telescope including an eyepiece mounted via an adapter in the bore of the gun barrel for boresighting, having a BCA removably coupled to the eyepiece, according to an example embodiment.

FIG. 4 depicts a tank 100 configured for boresighting having a boresight telescope 160 mounted via an adapter 150 coupled into the bore 18*a* of the gun barrel 18 for boresighting, where the BCA 310 is removably coupled to the eyepiece 161 of the boresight telescope 160 as shown in FIG. 3A, according to an example embodiment. As noted above, the BCA 310 is only used during boresight operations, and after boresighting the BCA 310 and boresight telescope 160 are removed to enable the weapon to be fired or otherwise be able to fired.

EXAMPLES

Disclosed embodiments are further illustrated by the following specific Examples, which should not be construed as limiting the scope or content of this Disclosure in any way.

An example boresighting operating procedure by a single user using a disclosed BCA is described below.

1. Boresighting is performed as per standard procedures by using a boresight telescope 160 attached to the bore 18*a* of the gun barrel 18 of a weapon (e.g. a tank) by an adapter (or mandrel) 150.
2. Having followed standard boresighting procedures, the centerline axis of the gun barrel 18 will be located.
3. A BCA 310 is applied onto (e.g., over) the outside of the eyepiece 161 of the boresight telescope 160 and the fasteners 316 (e.g., screws) are then tightened down. The user should apply the BCA 310 gently to the eyepiece 161 so as to not disturb the target/image/boresight telescope 160.
4. A video cable coupled to the photodetector array in the BCA 310 can be supported by VELCRO wraps to the gun tube.
5. The boresight telescope's reticle and the aiming reference (or "target") used to identify the centerline axis are displayed on a video display within a vehicle (e.g., a tank).
6. An operator/gunner will look at the image within the vehicle and set his or her gun sights on the cross hairs.
7. The gun will then be collimated (aligned) to the gunner's sight.

As described above, since the BCA is only used during the boresight operation, following boresighting the BCA and boresight telescope are removed from the weapon to enable the weapon to be fired or otherwise able to be fired.

The direct view provided to the operator/gunner through a disclosed BCA 310 is what is seen via the human eye viewing directly through the eyepiece 161. The characteristics of the boresight telescope 160 can further enhance the tuning accuracy by selecting a GRAFLEX boresight telescope (Graflex Incorporated, Jupiter, Fl) which provides a mechanical design with TIR not to exceed 0.005" from any point on the adapter 150 through to the boresight telescope 160 when engaged, allowing the operator/gunner to move the reticle in step 1 of the above-described boresighting operating procedure in azimuth and elevation to adjust for fine tuning accuracy to +/−0.02 angular mils. As noted in the background above, known direct view boresight cameras have actual tuning accuracy limited to no better than about +/−0.1 angular mils.

While various disclosed embodiments have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

Thus, the breadth and scope of the subject matter provided in this Disclosure should not be limited by any of the above explicitly described embodiments. Rather, the scope of this Disclosure should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. A method of boresighting, comprising:

providing a weapon including a bore having a centerline axis and a boresight telescope coupled into said bore, wherein said boresight telescope has a beam splitter therein which directs image information received from an aiming reference to an eyepiece of said boresight telescope which is off-axis relative to said centerline axis and raised above a tube of said boresight telescope;

removably coupling a housing of a boresight camera accessory (BCA) directly to said eyepiece, said BCA including an objective and a photodetector array, wherein said objective focuses said image information from said eyepiece to said photodetector array which generates sensing signals;

automatically transmitting said sensing signals to at least one remote viewer;

displaying a viewable image of said aiming reference from said sensing signals, and said remote viewer individually boresighting said weapon using said viewable image and a view of said aiming reference through said bore.

2. The method of claim 1, wherein said automatically transmitting is over a cable.

3. The method of claim 1, wherein said automatically transmitting is over a wireless media.

4. The method of claim 1, further comprising removing said boresight telescope and said BCA from said bore and then firing said weapon.

5. The method of claim 1, wherein said weapon comprises a tank, Gatling gun or a machine gun.

6. The method of claim 5, wherein said weapon comprises said tank, and wherein said remote viewer is a tank operator inside said tank.

7. The method of claim 1, wherein an adapter couples said boresight telescope into said bore.

8. The method of claim 1, wherein said housing is removably coupled to said eyepiece by a fastener through a grommet inserted in a first and at least a second hole in said housing, said grommet being flared or collared on each side, wherein said fastener is extendable into said housing.

9. The method of claim 1, wherein said BCA includes an aperture stop lens cap including a hole optically coupled to said objective for providing near parallax-free operation, and said housing is sealed to avoid entrance of contaminants therein.

10. A firing system, comprising a weapon comprising a bore having a centerline axis;

a boresight telescope coupled into said bore, wherein said boresight telescope has a beam splitter therein which directs image information received from an aiming reference to an eyepiece of said boresight telescope which is off-axis relative to said centerline axis and raised above a tube of said boresight telescope;

a boresight camera accessory (BCA) having a housing that is removably and directly coupled to said eyepiece, comprising:

said housing having an outer surface, a first end, and a second end opposite said first end;

an objective recessed from said first end secured within said housing;

a photodetector array, wherein said objective focuses image information received from said eyepiece to said photodetector array which generates sensing signals, and a cable or transmitter for automatically transmitting said sensing signals to at least one remote viewer.

11. The firing system of claim 10, further comprising an adapter for coupling said boresight telescope into said bore.

12. The firing system of claim 10, wherein said remote viewer is a fire control operator inside a vehicle having a fire control system therein.

13. The firing system of claim 10, wherein said cable comprises an optical cable.

14. The firing system of claim 10, wherein said transmitter comprises a wireless transmitter.

15. The firing system of claim 10, wherein said BCA is removably coupled to said eyepiece by a fastener through a grommet inserted in a first and at least a second hole in said housing, said grommet being flared or collared on each side, wherein said fastener is extendable into said housing.

16. The firing system of claim 10, wherein said BCA includes an aperture stop lens cap including a hole optically coupled to said objective for providing near parallax-free operation, and said housing is sealed to avoid entrance of contaminants therein.

* * * * *